US009191736B2

(12) United States Patent
Lu et al.

(10) Patent No.: US 9,191,736 B2
(45) Date of Patent: Nov. 17, 2015

(54) MICROPHONE APPARATUS

(71) Applicant: Fortemedia, Inc., Sunnyvale, CA (US)

(72) Inventors: Yan-Chen Lu, Taipei (TW); Shien-Neng Lai, Taipei (TW); Tsan Hung Tsai, Taipei (TW); Chun-Ming Hsu, Taipei (TW)

(73) Assignee: FORTEMEDIA, INC., Sunnyvale, CA (US)

( * ) Notice: Subject to any disclaimer, the term of this patent is extended or adjusted under 35 U.S.C. 154(b) by 268 days.

(21) Appl. No.: 13/792,906

(22) Filed: Mar. 11, 2013

(65) Prior Publication Data

US 2014/0254824 A1 Sep. 11, 2014

(51) Int. Cl.
*H04R 1/40* (2006.01)

(52) U.S. Cl.
CPC ..... *H04R 1/406* (2013.01); *H04R 2430/20* (2013.01); *H04R 2499/15* (2013.01)

(58) Field of Classification Search
None
See application file for complete search history.

(56) References Cited

U.S. PATENT DOCUMENTS

| | | | | |
|---|---|---|---|---|
| 2005/0036814 | A1* | 2/2005 | Sim | 400/472 |
| 2011/0058676 | A1* | 3/2011 | Visser | 381/17 |
| 2012/0019689 | A1* | 1/2012 | Zurek et al. | 348/240.99 |
| 2012/0293936 | A1* | 11/2012 | Wu et al. | 361/679.4 |
| 2013/0329908 | A1* | 12/2013 | Lindahl et al. | 381/92 |
| 2013/0329915 | A1* | 12/2013 | Andre et al. | 381/122 |
| 2014/0112517 | A1* | 4/2014 | Farahani et al. | 381/365 |
| 2014/0169576 | A1* | 6/2014 | Sun et al. | 381/71.1 |
| 2014/0219471 | A1* | 8/2014 | Deshpande et al. | 381/92 |

* cited by examiner

*Primary Examiner* — Paul Huber
(74) *Attorney, Agent, or Firm* — McClure, Qualey & Rodack, LLP

(57) ABSTRACT

A microphone array disposed on a two-piece computer is provided. The two-piece computer has a first piece with a keyboard disposed thereon and a second piece with a display screen disposed thereon. The microphone array has two microphones, which are both disposed on the first piece, wherein a connecting line of the two microphones is not vertical to a normal line of the display screen of the second piece.

5 Claims, 6 Drawing Sheets

MICROPHONE APPARATUS

BACKGROUND OF THE INVENTION

1. Field of the Invention

The present invention relates to microphone arrays, and in particular, relates to microphone arrays disposed on electronic devices.

2. Description of the Related Art

Microphone arrays, which can help to eliminate noise and wind shear sound and record sound more clearly, have gradually become essential components of consumer electronic products such as notebooks or mobile phones.

The microphone array disposed on a notebook computer can be used for many applications. However, in most of these applications, the microphone array only needs to receive sounds from the user who is right in front of the notebook.

Therefore, the present invention provides new microphone arrays for notebooks, which can appropriately remove the other sounds that come from the back of the notebook.

BRIEF SUMMARY OF INVENTION

A microphone array disposed on a two-piece computer is provided. The two-piece computer has a first piece with a keyboard disposed thereon and a second piece with a display screen disposed thereon. The microphone array comprises two microphones, which are both disposed on the first piece, wherein a connecting line of the two microphones is not vertical to a normal line of the display screen of the second piece.

A detailed description is given in the following embodiments with reference to the accompanying drawings.

BRIEF DESCRIPTION OF DRAWINGS

The present invention can be more fully understood by reading the subsequent detailed description and examples with references made to the accompanying drawings, wherein.

DETAILED DESCRIPTION OF INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
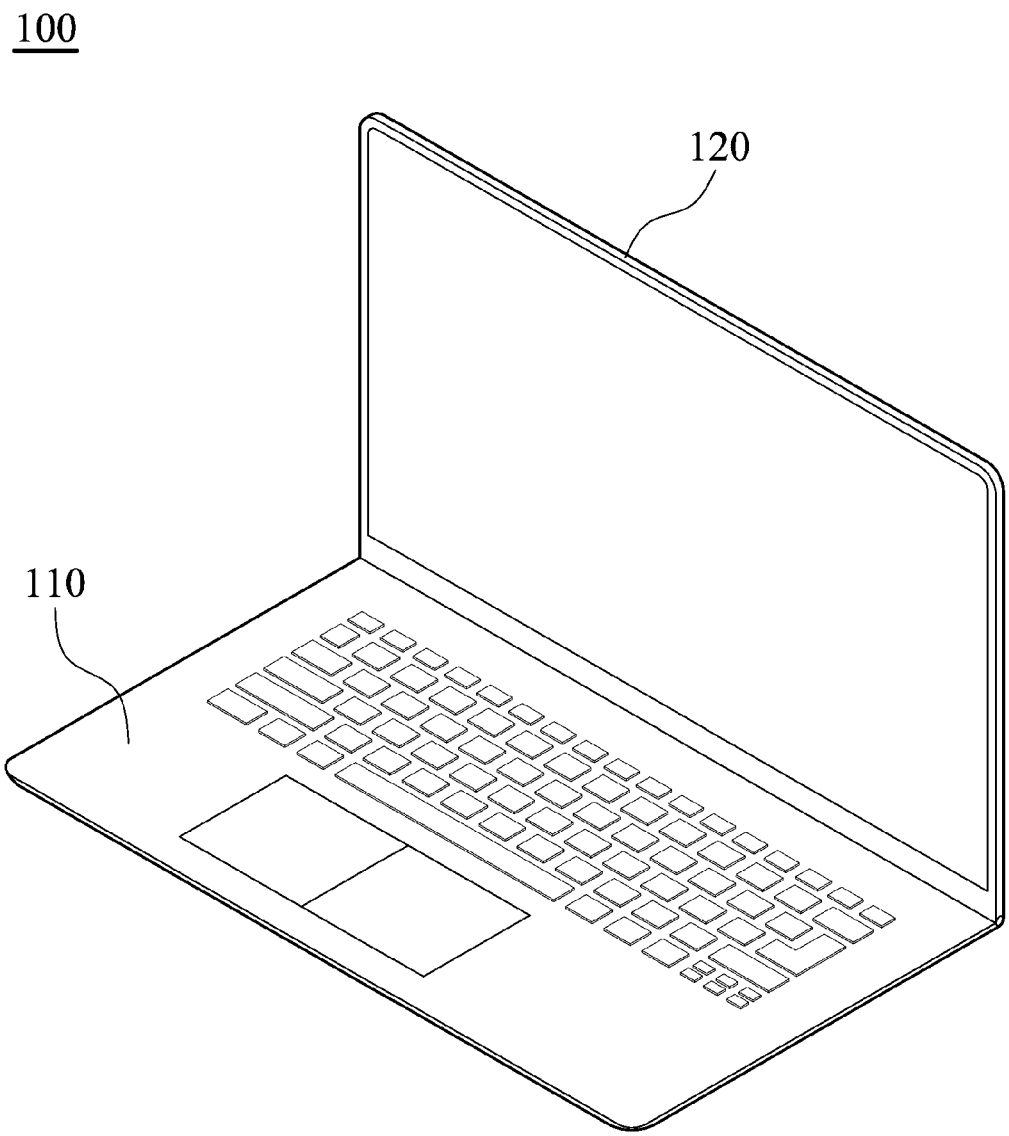
FIG. 1 shows the outside view of a notebook computer.

The microphone array of the present invention is designed to be applied to a two-piece computer such as a notebook computer. FIG. 1 shows the outside view of a notebook computer. As the name implies, notebook computers (hereinafter, "notebook" for short) are foldable like a book and people can use it to "take notes". The notebook 100, as shown in FIG. 1, can be structurally divided into two parts: a first piece 110 and a second piece 120. The first piece 110 is the base of the notebook, which has input devices such as a keyboard and/or a touchpad disposed thereon. The second piece 120 can be flipped over the first piece 110, and has a display screen on a side facing to the user, as shown in FIG. 1.

Figure 2:
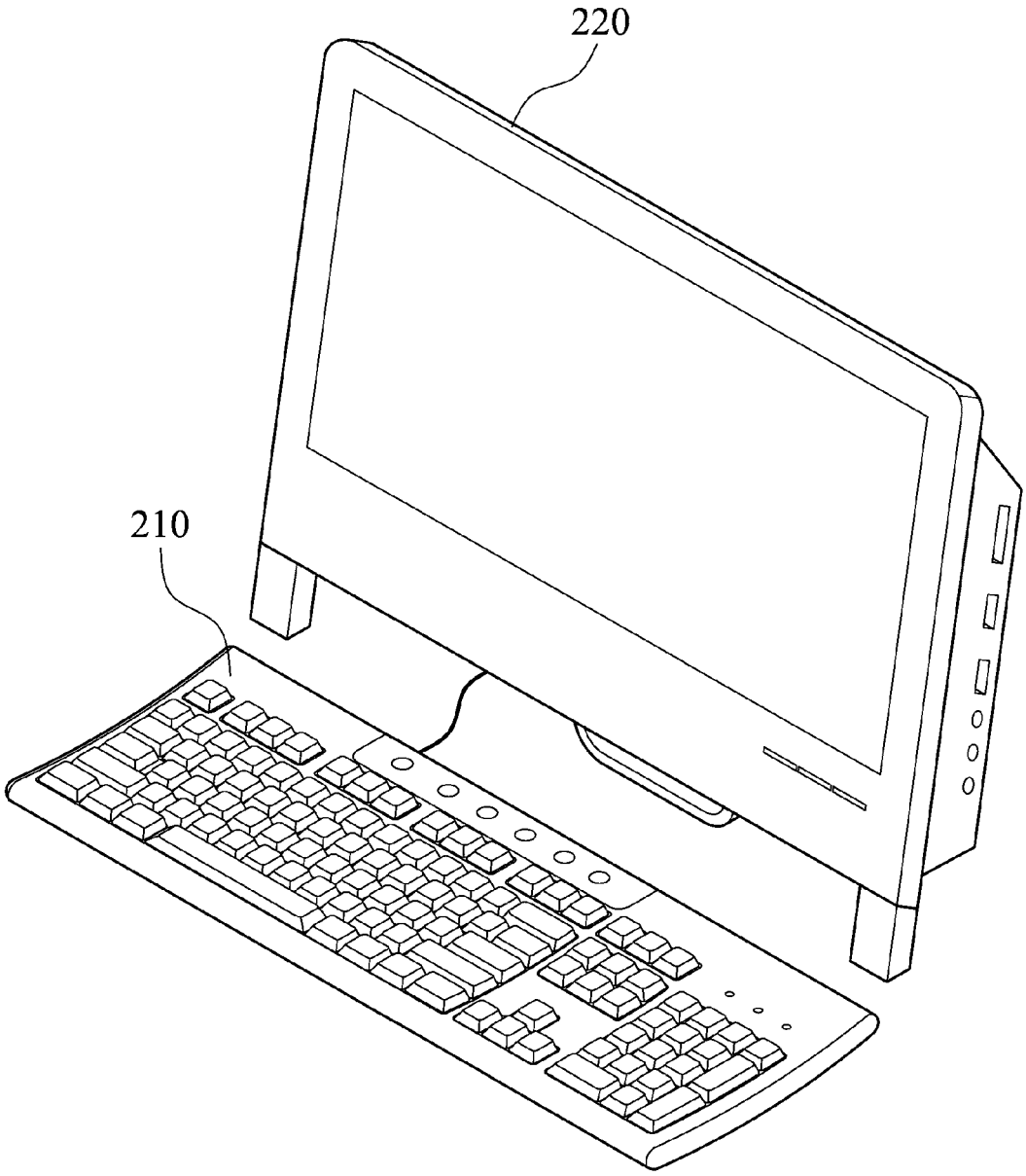
FIG. 2 shows an AIO computer with an external keyboard.
Figure 3:
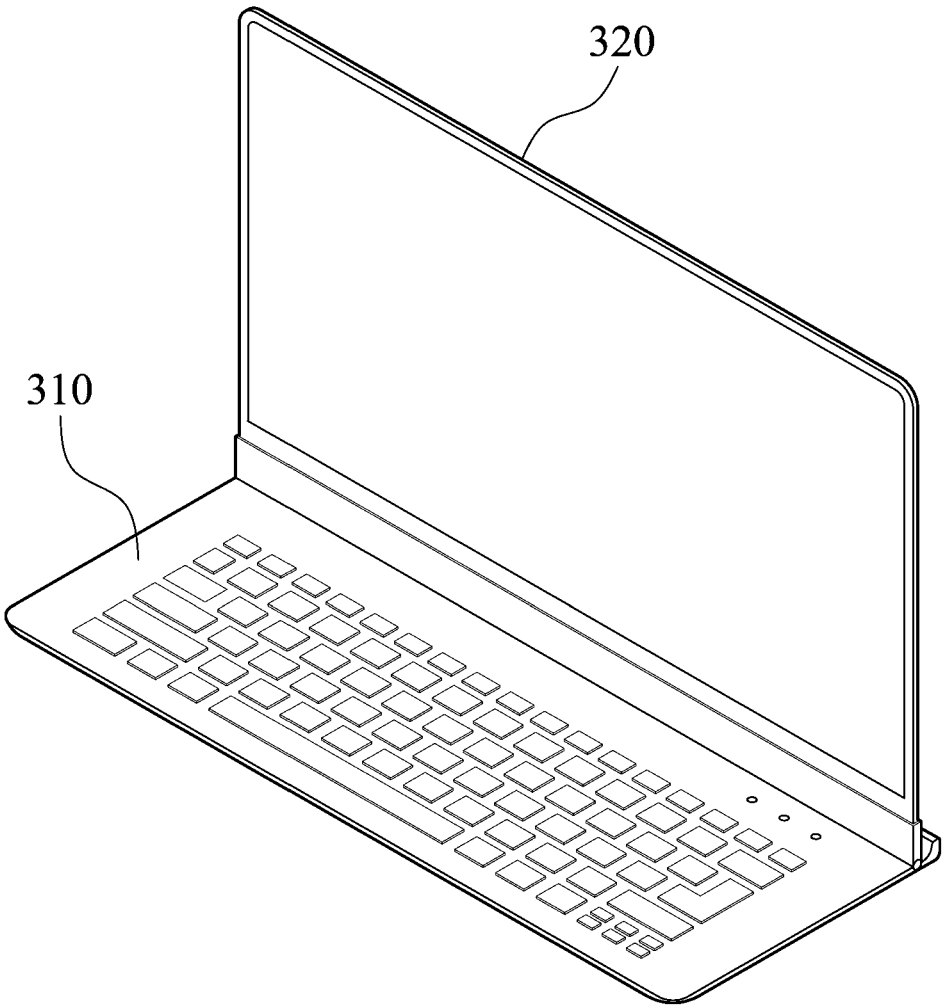
FIG. 3 shows a tablet and a keyboard station.

Note that the notebook in the following embodiments are merely for illustration, however, the microphone array of the present invention can be applied on any two-piece computer. For example, the two-piece computer can be an all-in-one (AIO) computer with an external keyboard. FIG. 2 shows an AIO computer 210 with an external keyboard 220, where the AIO computer 210 and the external keyboard 220 are respectively the first piece and the second piece of the present invention. For another example, the two-piece computer can be a tablet docked on a station. FIG. 3 shows a tablet 310 and a keyboard station 320. The tablet 310, the first piece, can be used alone, or docked on the keyboard station 320, the second piece, to form the two-piece computer defined by the present invention.

Figure 4:
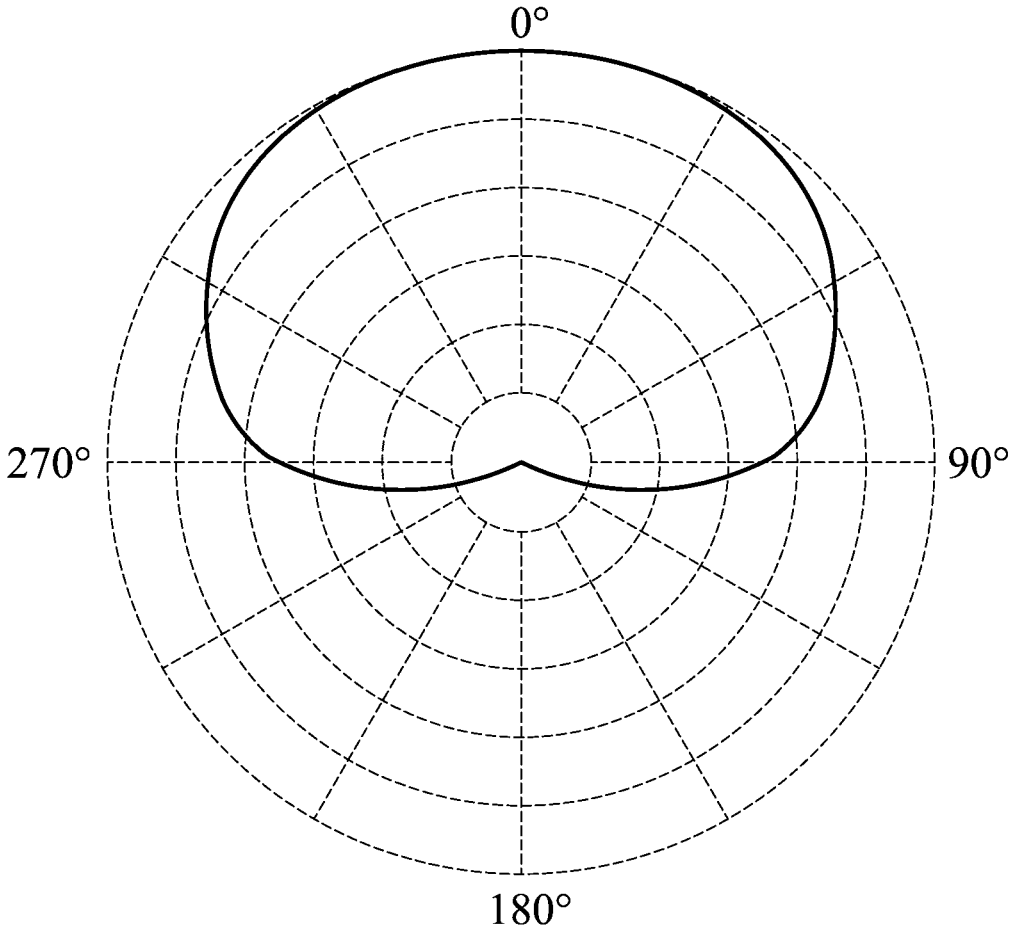
FIG. 4 shows the polar pattern of the microphone array of the present invention.

FIG. 4 shows the polar pattern of the microphone array of the present invention. The microphone polar pattern (i.e., microphone's directionality) indicates how sensitive the microphone array is to sounds arriving at different angles about its central axis. The microphone array disposed on the notebook in the prior art is usually omnidirectional, which means that it has similar sensitivity to sounds from all around the notebook (360 degrees). However, in most cases, the sounds from the back the notebook are unnecessary noises and should be eliminated. Therefore, the microphone array of the present invention achieves a semi-omnidirectional microphone polar pattern (180 degrees) for focusing on receiving the sounds from the front of the notebook. It should be noted that, in order to achieve this polar pattern without increasing the burden for processing signals from the microphone array, the arrangement for the microphones is considerably important.

A microphone array of the present invention comprises two microphones, and both microphones are disposed on the first piece of the notebook (i.e., 110 in FIG. 1). Both of the microphones of the present invention are not configured on the second piece (i.e., 120 in FIG. 1), thus, preventing the cost and the inconvenience for embedding the microphones onto the fragile display screen of the second piece. In addition, the two microphones of the present invention are formed in such an arrangement that a connecting line of the two microphones is not vertical to a normal line of the display screen of the second piece of the notebook (i.e., 120 in FIG. 1). In mathematics, two lines in a 3D space are orthogonal (vertical to each other) when the dot product of their vectors is zero. There are two embodiments in the present invention, which will be described in the following.

Figure 5:
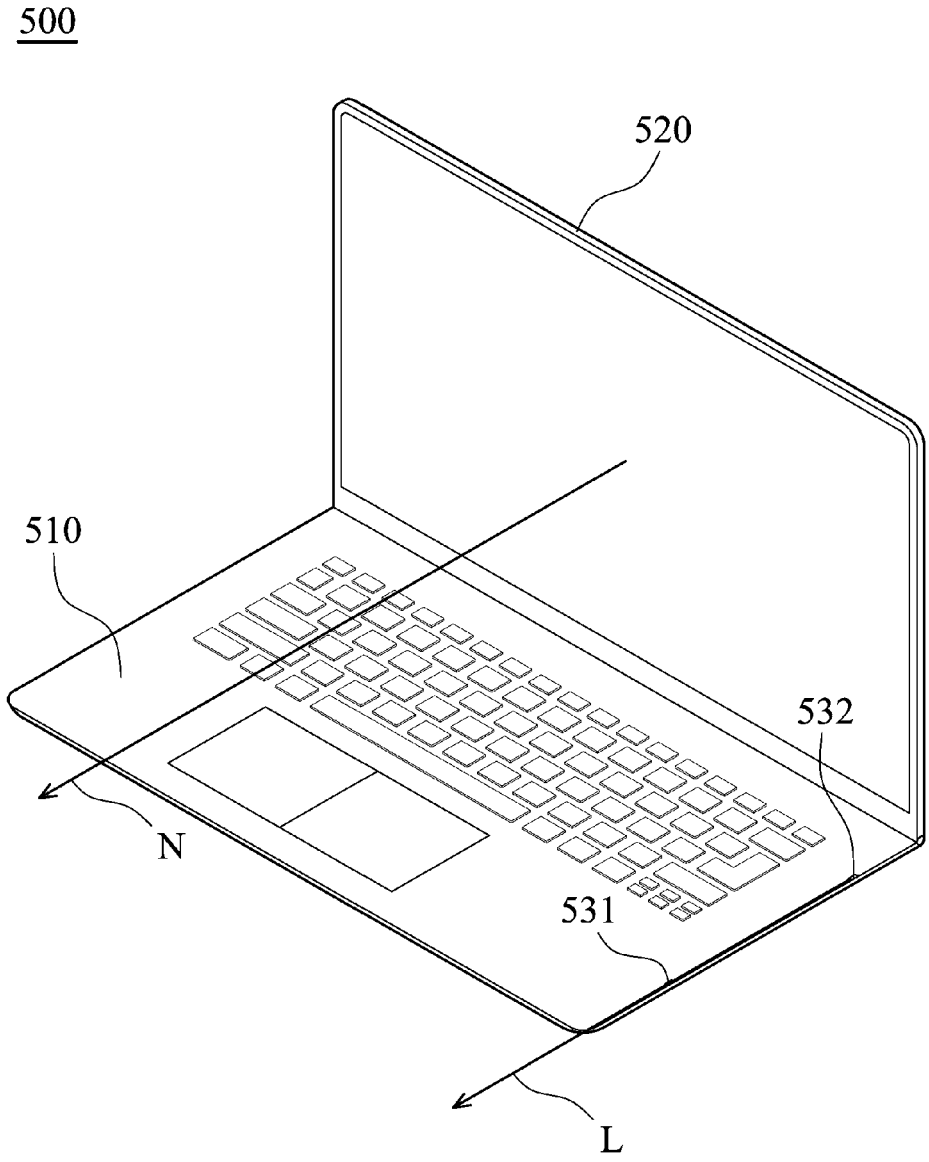
FIG. 5 is a schematic diagram of the microphone according to a first embodiment of the present invention.

FIG. 5 is a schematic diagram of the microphone according to a first embodiment of the present invention. In this embodiment, the first microphone 531 and the second microphone 532 are both disposed on the first piece 510 of the notebook 500. In addition, the first microphone 531 and the second microphone 532 in this embodiment are formed in such an arrangement that the connecting line L of the two microphones 531 and 532 is parallel to the normal line N of the display screen of the second piece 520 of the notebook 500, as shown in FIG. 5. Specifically, the first microphone 531 and the second microphone 532 can be both disposed on the left or right edge on the first piece 510 of the notebook 500. In this arrangement, the connecting line L of the two microphones 531 and 532 is obliquely oriented to the user who is in front of the notebook 500.

To further reduce signal processing burden, in a better embodiment, the connecting line L of the two microphones should be more oriented to the user in front of the notebook.

Figure 6:
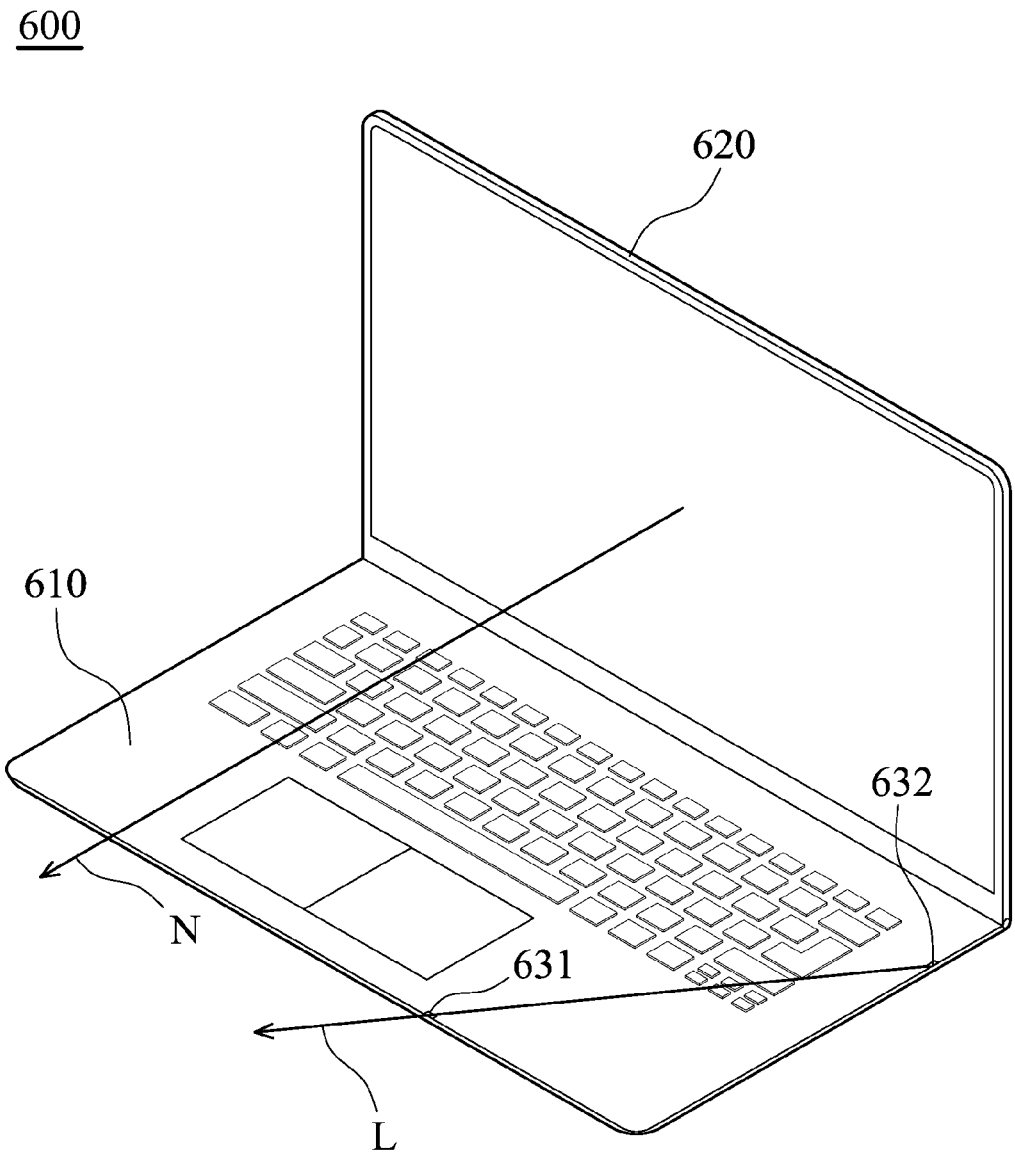
FIG. 6 is a schematic diagram of the microphone according to the second embodiment of the present invention.

Therefore, the present invention provides a preferred second embodiment. FIG. 6 is a schematic diagram of the microphone according to the second embodiment of the present invention. In this embodiment, the first microphone 631 and the second microphone 632 are both disposed on the first piece 610 of the notebook 600. In addition, the first microphone 631 and the second microphone 632 in this embodiment are formed in such an arrangement that the connecting line L of the two microphones 631 and 632 and the normal line N of the display screen of the second piece 620 of the notebook 600 intersect at an acute angle (between 0 degree to 90 degree), as shown in FIG. 6. Specifically, the first microphone 631 can be disposed on the front edge on the first piece 610 of the notebook 600, while the second microphone 632 can be disposed on the left edge or right edge on the first piece 610 of the notebook 600.

In the above embodiments, the first microphone 531/631 can be a main microphone, which is closer to the user (who is in front of the notebook) for collecting more sounds from the user than noises from the environment, and the second microphone 532/632 can be a reference microphone, which is further from the user for collecting more noises from the environment than the sounds from the user. In some embodiments, the microphone array of the present invention further comprises a beamformer (not shown), which is coupled to the first microphone and the second microphone for receiving and processing the signals from them to form the semi-omnidirectional polar pattern as shown in FIG. 4. Since those skilled in the art can use various algorithms to process the microphone signals, they will not be discussed further hereinafter.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A microphone array disposed on a two-piece computer, wherein the two-piece computer has a first piece with a keyboard disposed thereon and a second piece with a display screen disposed thereon, the microphone array comprising:

first and second microphones, both disposed on the first piece, wherein a connecting line of the first and second microphones is not perpendicular to a normal line of the display screen of the second piece;

wherein the first microphone is disposed on a front edge on the first piece, and the second microphone is disposed on a side edge adjacent to the front edge;

wherein the front edge on the first piece is an edge closer to user.

2. The microphone array disposed on a two-piece computer as claimed in claim 1, wherein the connecting line of the first and second microphones and the normal line of the display screen of the second piece intersect at an acute angle.

3. The microphone array disposed on a two-piece computer as claimed in claim 2, wherein the two-piece computer is a notebook, and the second microphone is disposed on the left edge on the first piece of the notebook.

4. The microphone array disposed on a two-piece computer as claimed in claim 2, wherein the two-piece computer is a notebook, the second microphone is disposed on the right edge on the first piece of the notebook.

5. The microphone array disposed on a two-piece computer as claimed in claim 2, further comprising:

a beamformer, coupled to the first microphone and the second microphone, for receiving and processing signals from the first microphone and the second microphone to form a semi-omnidirectional polar pattern.

* * * * *